US005651695A

United States Patent [19]

Lee et al.

[11] Patent Number: 5,651,695

[45] Date of Patent: Jul. 29, 1997

[54] CONNECTOR FOR ELECTRIC WIRES

[75] Inventors: Hyoung Ku Lee, Seoul; Heung Sik Lee, Kyoungki-Do, both of Rep. of Korea

[73] Assignee: Berg Technology, Inc., Reno, Nev.

[21] Appl. No.: 569,229

[22] PCT Filed: Jul. 18, 1994

[86] PCT No.: PCT/US94/08020

§ 371 Date: Apr. 19, 1996

§ 102(e) Date: Apr. 19, 1996

[87] PCT Pub. No.: WO95/02906

PCT Pub. Date: Jan. 26, 1995

(Under 37 CFR 1.47)

[30] Foreign Application Priority Data

Jul. 16, 1993 [KR] Rep. of Korea ..... 93-13448
Apr. 22, 1994 [KR] Rep. of Korea ..... 94-8370

[51] Int. Cl.[6] ..... H01R 9/07

[52] U.S. Cl. ..... 439/495; 439/350; 439/701; 439/930

[58] Field of Search ..... 439/345, 350, 439/351, 470, 492, 495, 499, 695, 701, 930

[56] References Cited

U.S. PATENT DOCUMENTS

| | | | |
|---|---|---|---|
| 3,149,897 | 9/1964 | Martinek . | |
| 4,695,108 | 9/1987 | Ichitsubo | 439/59 |
| 4,913,662 | 4/1990 | Noy | 439/498 |
| 5,110,305 | 5/1992 | Edgley et al. | 439/441 |
| 5,308,262 | 5/1994 | Chishima | 439/495 |

FOREIGN PATENT DOCUMENTS

0282194 A1 9/1988 European Pat. Off. .

*Primary Examiner*—Khiem Nguyen
*Attorney, Agent, or Firm*—Woodcock Washburn Kurtz Mackiewicz & Norris

[57] ABSTRACT

A connector (9) for electrically connecting a cable (10) including a bundle of electric wires (13) to a printed circuit board where the connector includes a connector body (1), a housing (12) formed to support wires of the cable integrally with one another and capable of being coupled to the connector body. The connector body includes at least one pair of facing supports (4) provided at edges of the connector body and adapted to support the housing so as to prevent the cable from being easily separated from the connector body when external force or tension is applied where at least one support of the connector body has a hook (5) adapted to engage with an edge of the housing.

14 Claims, 7 Drawing Sheets

CONNECTOR FOR ELECTRIC WIRES

FIELD OF THE INVENTION

The present invention relates to a connector for electric wires, and more particularly to a connector adapted to electrically connect a cable including a bundle of electric wires to a printed circuit board ("PCB") by receiving the electric wires of the cable.

BACKGROUND OF THE INVENTION

When a cable is electrically connected to a PCB, the connection is not made directly, but rather via an electrical connector. Conventionally, these electrical connector include a connector body having wire receiving ports in which wires of the cable are received. In each wire receiving port, a wire is fixedly interposed between the connector body and an elastic member connected to a connector lead.

Conventionally, when an external force or tension is applied to the cable, the wires of the cable fixedly interposed in the wire receiving ports of the connector may become separated from the connector. As a consequence, the electrical contact of the cable to the PCB via the electrical connector may become unreliable.

SUMMARY OF THE INVENTION

An object of the present invention is to solve the above-mentioned problems encountered in the prior art. An electrical connector of the present invention includes supports where at least one support has a hook, to firmly engage a housing coupled to a cable to the electrical connector. The supports of the electrical connector of the present invention and the housing for the cable work together to help prevent wires of the cable from being easily separated from the wire receiving ports of the connector when an external force or tension is applied to the cable.

In accordance with the present invention, this object and others may be accomplished by providing an electrical connector which includes a connector body and a housing for a cable where the housing is formed to support wires of the cable integrally with one another and coupled to said connector body. In addition, a plurality of wire receiving ports are formed in the connector body and adapted to receive wires of the cable. At least two facing supports are provided at edges of the connector body and adapted to support the housing so as to prevent the cable from being easily separated from the connector body due to an external force or tension being applied to the cable. Finally, a hook is provided on at least one of the supports and adapted to engage an edge of the housing.

BRIEF DESCRIPTION OF THE DRAWINGS

Other objects and aspects of the invention will become apparent from the following description of embodiments with reference to the accompanying drawings, in which.

DETAILED DESCRIPTION OF THE PREFERRED EMBODIMENTS

Figure 1:
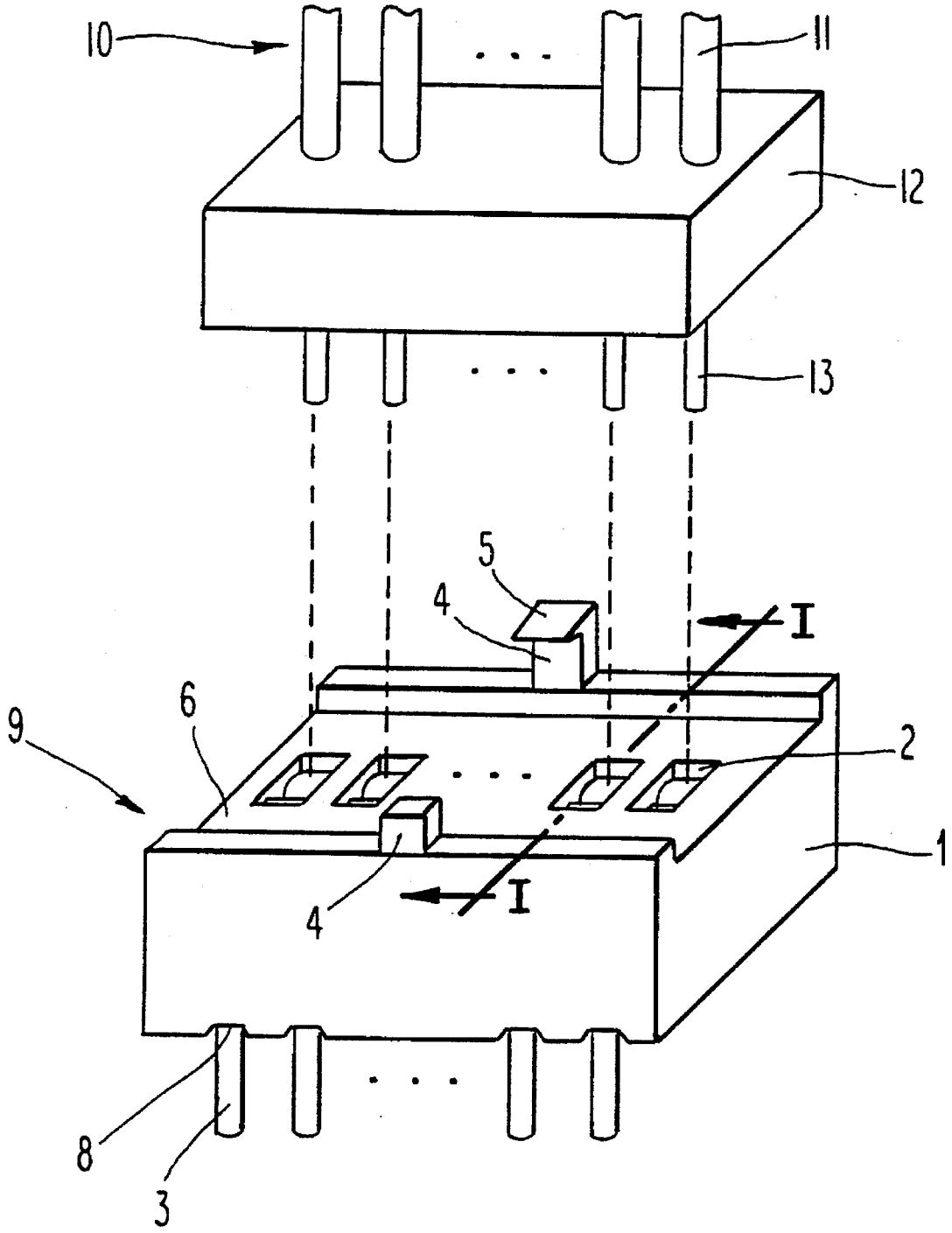
FIG. 1 is a perspective view of a first embodiment of a connector of the present invention, illustrating a ribbon cable coupled to the connector.

FIG. 1 is a perspective view of a first embodiment of an electrical connector 9 of the present invention before a ribbon cable or cable having electrical wires 10 is coupled to the connector 9. As shown in FIG. 1, the connector 9 includes a connector body 1 which has a plurality of wire receiving ports 2 and a pair of supports 4 centrally protruding from front and rear edges of an upper surface of the connector body 1. One of the supports 4 has a hook 5. A recess 6 is centrally provided at the upper surface of the connector body 1. The recess 6 extends throughout the width of the connector body 1. A housing 12 is molded for supporting core wires 13 of the ribbon cable 10 integrally with one another. When the core wires 13 of the ribbon cable 10 are received in corresponding wire receiving ports 2 of the connector body 1, the housing 12 is seated on the recess 6 and firmly engaged and supported by the supports 4 and the hook 5.

Figure 2:
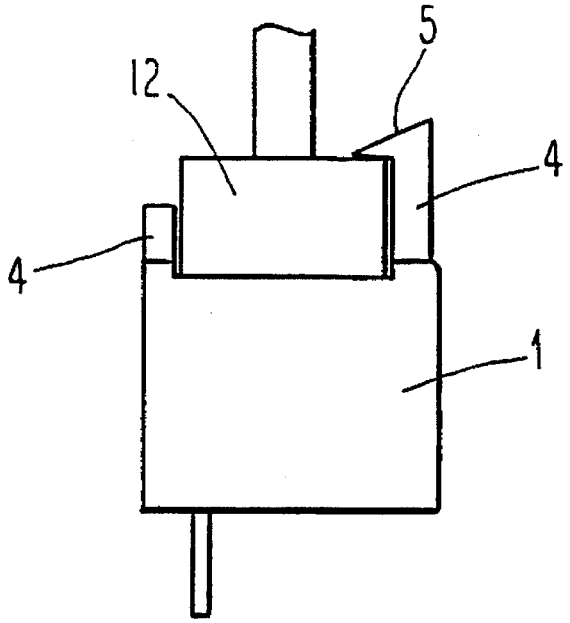
FIG. 2 is a side view of the first embodiment of the connector of the present invention, illustrating the ribbon cable coupled to the connector.

FIG. 2 is a diagram of the ribbon cable 10 coupled to the first embodiment of the connector of the present invention. As shown in FIG. 2, the housing 12 is seated on the recess 6 of connector body 1 and firmly supported at its front and rear surfaces by the supports 4. The hook 5 provided at the upper end of one of the supports 4 supports an upper edge of the housing 12. In this embodiment of the invention, a support 4 which does not have a hook is smaller in height than the housing 12.

Figure 3:
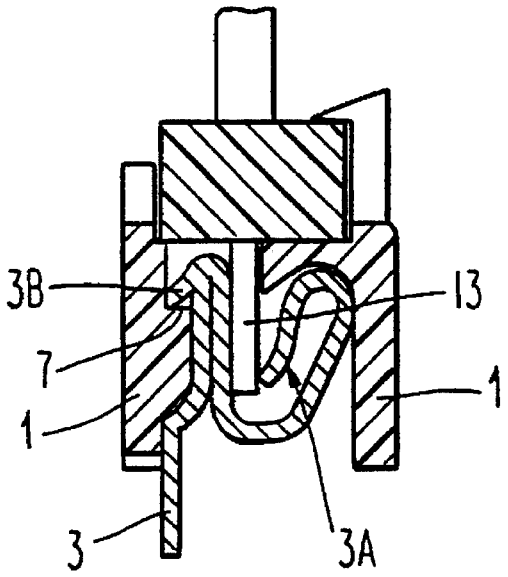
FIG. 3 is a cross-sectional view taken along the line I—I of FIG. 1, illustrating the ribbon cable coupled to the first embodiment of the connector of the present invention.

FIG. 3 is a cross-sectional view of the connector of the first embodiment of the invention taken along the line I—I of FIG. 1, illustrating the ribbon cable coupled to the connector. As shown in FIG. 3, the connector body 1 includes a connector lead 3 mounted in each wire receiving port 2. The connector lead 3 is upwardly inserted into the connector body 1. The connector lead 3 has an elastic member 3A at one end thereof and an engaging member 3B at the intermediate portion thereof. The elastic member 3A serves to make the corresponding wire 13 come into close contact with the connector lead 3. When the connector lead 3 is inserted into the connector body 1, the engaging member 3B of connector lead 3 is engaged with a step 7 formed at an inner surface of the connector body 1 so as to prevent the connector lead 3 from being separated from the connector body 1.

Figure 4:
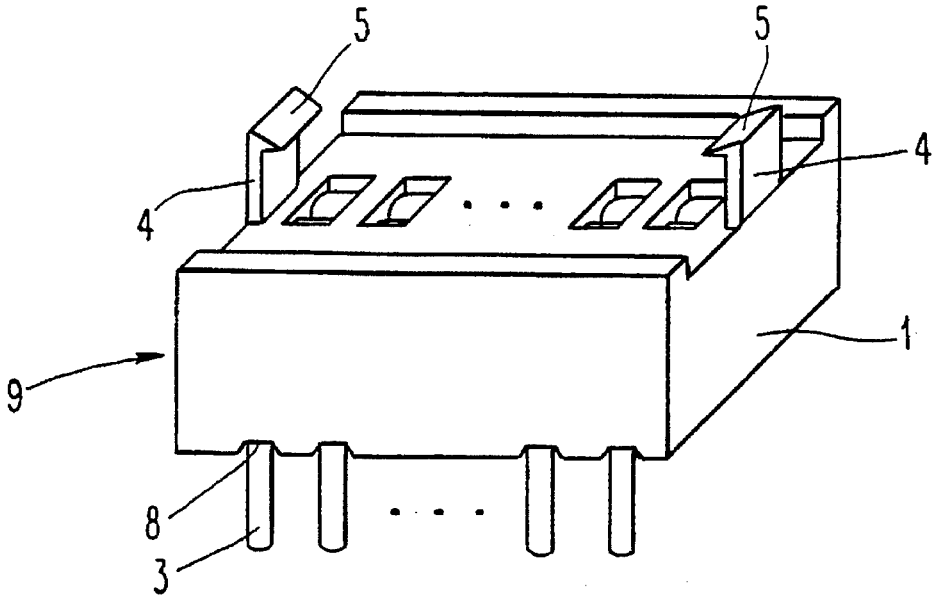
FIG. 4 is a perspective view of a second embodiment of the connector of the present invention.

FIG. 4 is a perspective view of a second embodiment of the connector of the present invention. This connector has the same construction as the first embodiment, except for the positions of the supports 4. In particular, the supports 4 in the second embodiment of the invention are provided at the left and right edges of the upper surface of the connector body 1, respectively. In another embodiment of the invention, the connector body 1 may have four supports provided at all four edges of the upper surface. In such an embodiment, one or more of the supports may have hooks.

Figure 5:
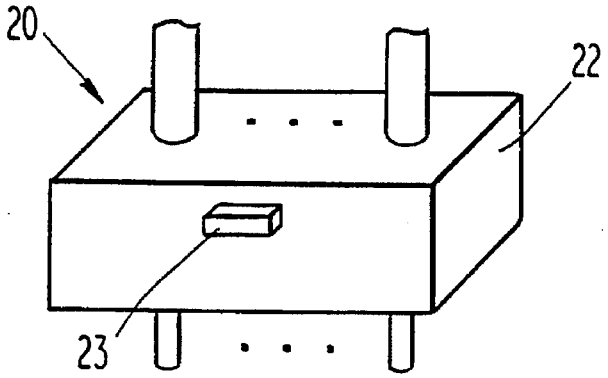
FIG. 5 is a perspective view illustrating a housing molded on a ribbon cable in accordance with a third embodiment of the present invention.
Figure 6:
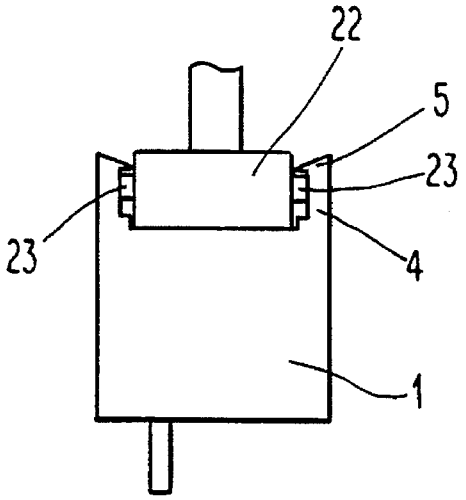
FIG. 6 is a side view of the third embodiment of the connector of the present invention illustrating the housing coupled to the connector.

FIG. 5 is a perspective view of a third embodiment of the connector of the present invention illustrating a housing molded on a ribbon cable in accordance with the third embodiment of the present invention. The housing 22 has a pair of protrusions 23 which are centrally formed at front and rear surfaces of the housing 22, respectively. In this embodiment of the invention, the connector 1 has supports 4 each having a hook 5 which engages a corresponding protrusion 23 of the housing 22. FIG. 6 is a side view of the third embodiment of the connector of the present invention which shows the housing 22 coupled to the connector 1 by virtue of the supports 4, hooks 5, and protrusions. The height of each support 4 and thus hook 5 provided at the upper end of each support 4 should be determined by taking into consideration the level of each corresponding protrusion 23 of the housing 22.

Figure 7:
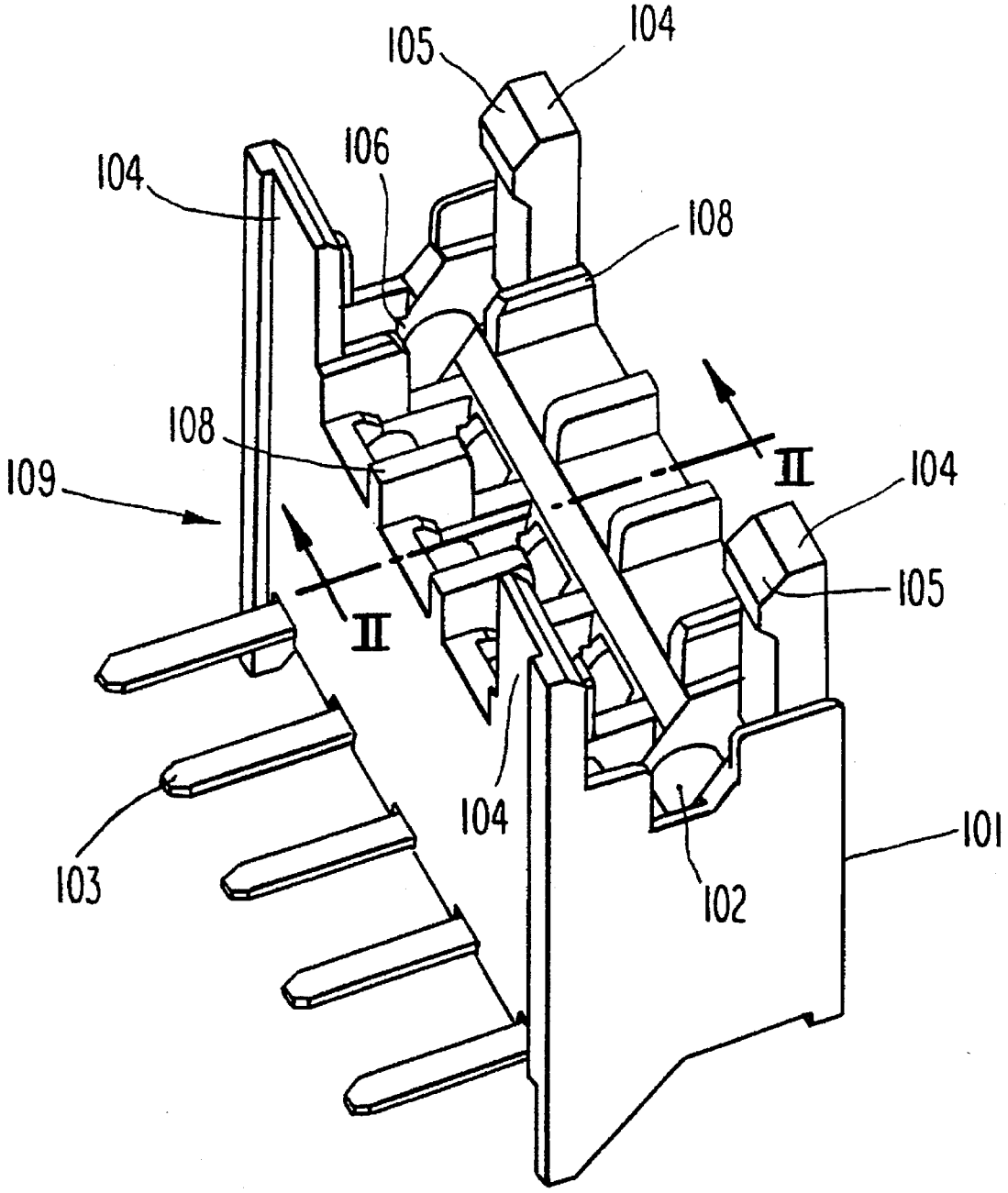
FIG. 7 is a perspective view of the fourth embodiment of the connector of the present invention.
Figure 13:
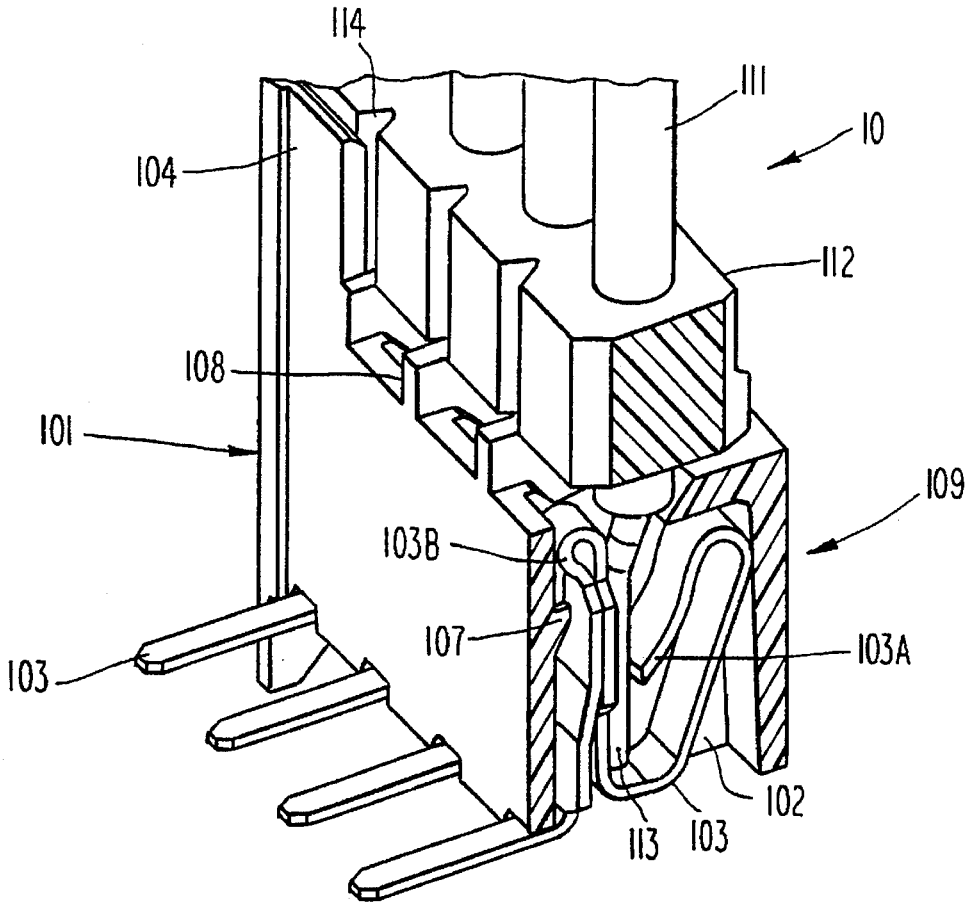
FIG. 13 is a cross-sectional view taken along the line II—II of FIG. 7, illustrating the ribbon cable coupled to the fourth embodiment of the connector of the present invention.
Figure 12:
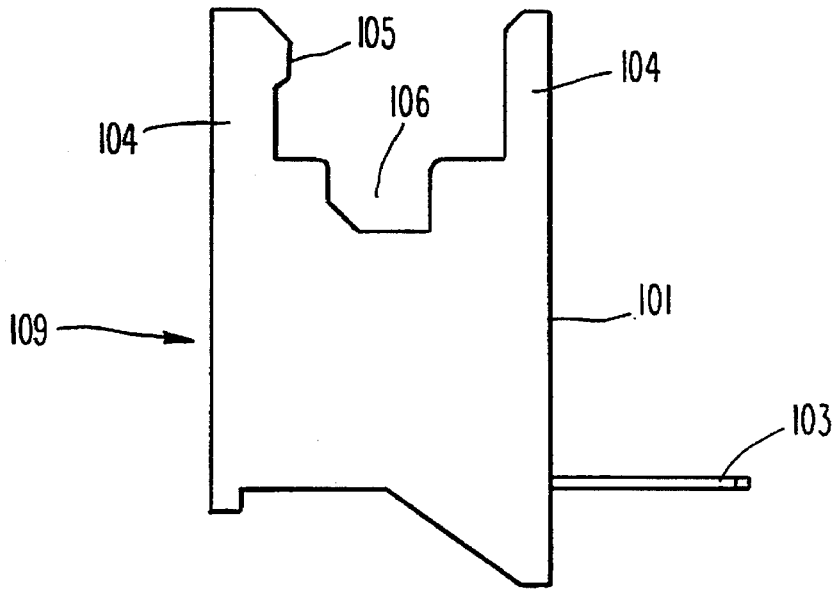
FIG. 12 is a side view of the fourth embodiment of the connector of the present invention.

FIG. 7 is a perspective view of a fourth embodiment of an electrical connector 109 of the present invention, before a cable 10 is coupled to the connector 109. As shown in FIG. 109, the connector of the fourth embodiment of the invention is a right angle connector in that the connector 109 is mounted at a right angle to the PCB relative to the mounting of a cable 10 to the connector 109. As also shown in FIG. 7, the connector 109 includes a connector body 101 which has a plurality of wire receiving ports 102 and a pair of supports 104 protruding from front and rear edges on each side of an upper surface of the connector body 101. One of each pair of the supports 104 has a hook 105. A recess 106 is centrally provided at the upper surface of the connector body 101. The recess 106 extends throughout the width of the connector body 101. The upper surface of the connector body 101 also includes protrusions 108 for engaging slots 114 of a housing 112 of the fourth embodiment of the present invention as shown in FIG. 13. The protrusions 108 and slots 114 help prevent the movement of the housing 112 and, consequently, the wires of the cable 10 due to any external lateral forces or tension on the cable 10.

Figure 8:
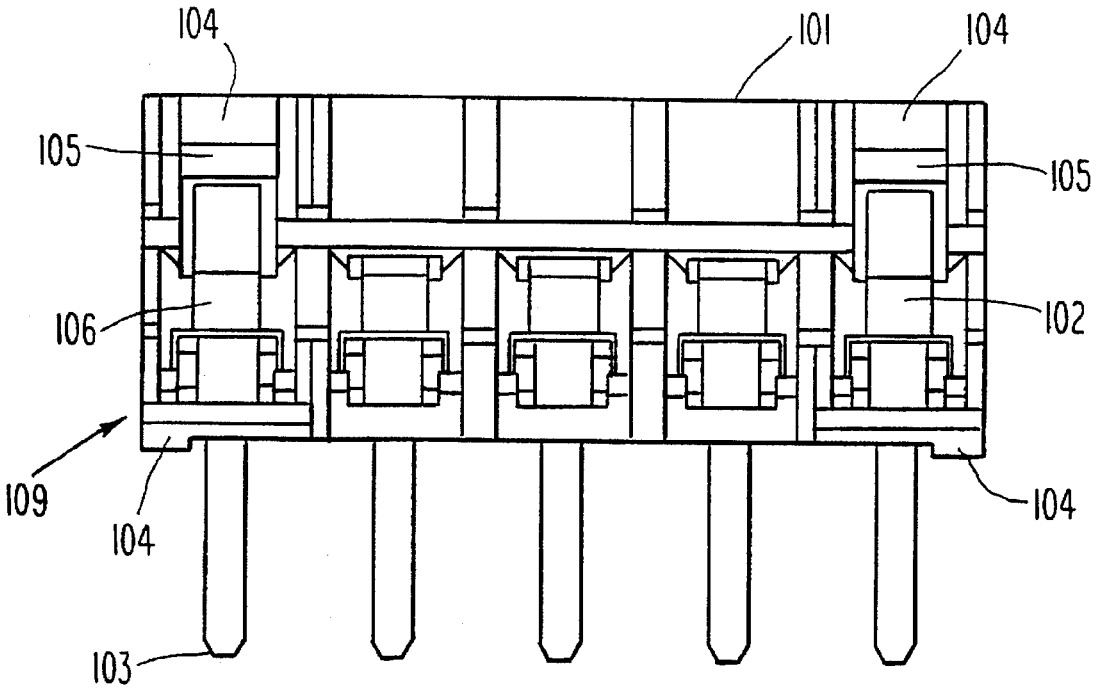
FIG. 8 is a top view of the fourth embodiment of the connector of the present invention.
Figure 9:
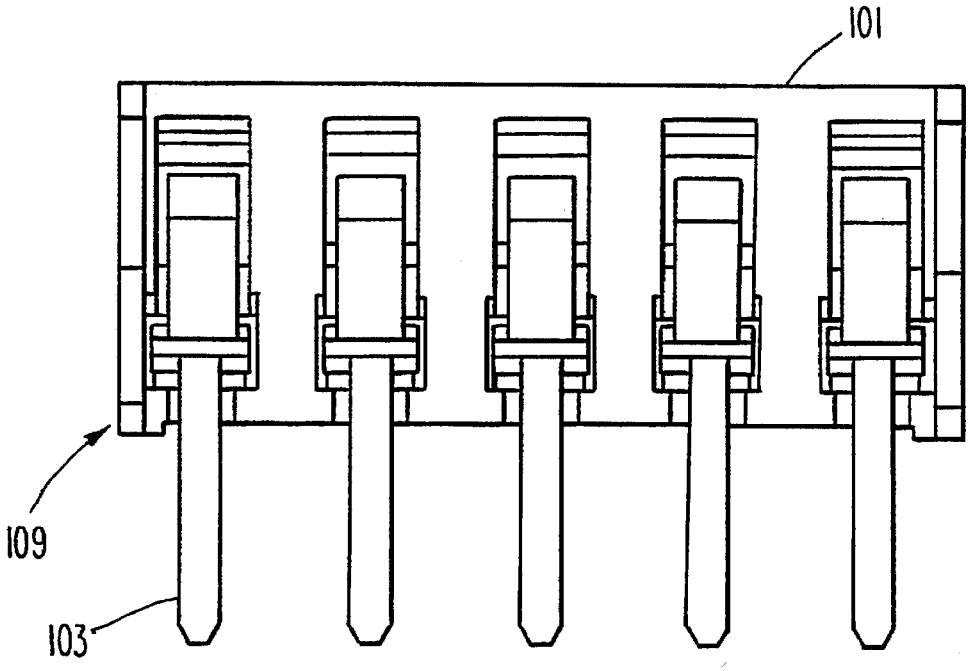
FIG. 9 is a bottom view of the fourth embodiment of the connector of the present invention.
Figure 10:
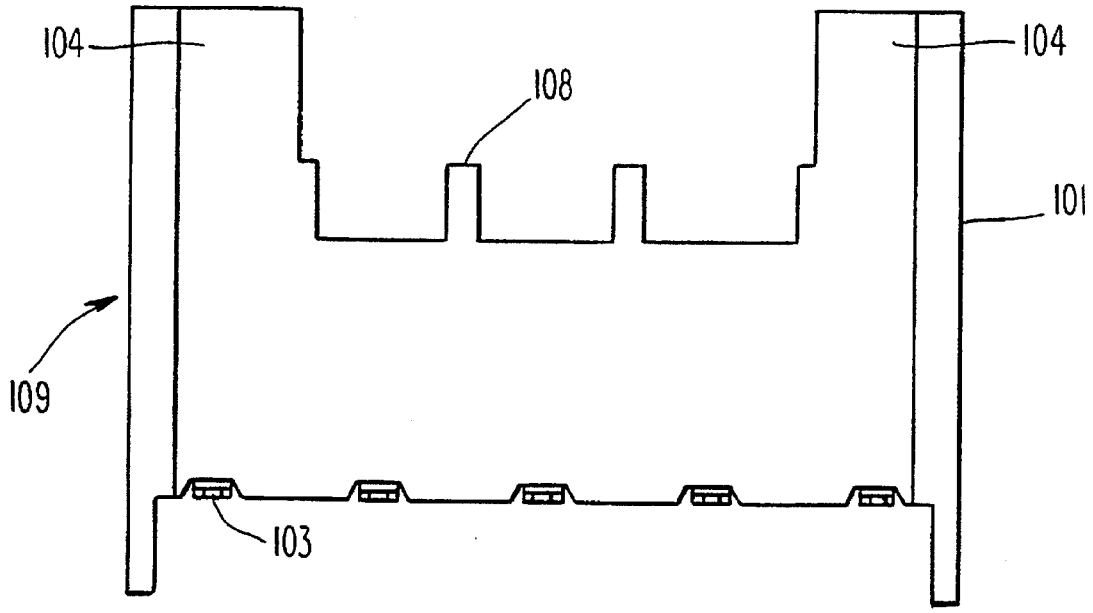
FIG. 10 is a front view of the fourth embodiment of the connector of the present invention.
Figure 11:
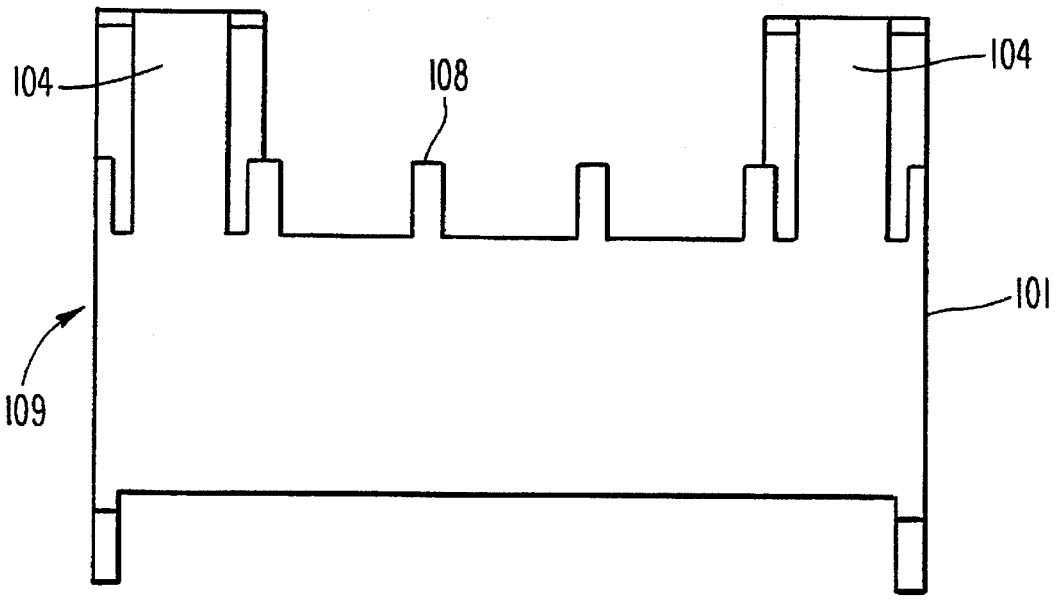
FIG. 11 is a rear view of the fourth embodiment of the connector of the present invention.

FIG. 8 is a top view, FIG. 9 is a bottom view, FIG. 10 is a front view, FIG. 11 is a rear view, and FIG. 14 is a side view of the connector body 101 of the fourth embodiment of the present invention. As shown in these figures, the connector body 101 of the fourth embodiment of the present invention includes a plurality of protrusions 108 and supports 4 for firmly engaging the housing 112 to prevent wires coupled to the connector body 101 in the wire receiving ports 102 from becoming uncoupled due to any external force or tension applied to the cable 10, whether lateral or vertical.

FIG. 13 is a diagram of the ribbon cable 10 coupled to the fourth embodiment of the connector of the present invention. As shown in FIG. 13, the housing 112 is seated on the recess 106 of connector body 101 and firmly supported at its front and rear surfaces by the supports 104. The hooks 105 provided at the upper end of one of each of the pair of supports 104 supports an upper edge of the housing 112. As also shown in FIG. 13, in the fourth embodiment of the invention, the housing 112 is molded for supporting core wires 13 of the ribbon cable 10 integrally with one another. When the core wires 13 of the ribbon cable 10 are received in corresponding wire receiving ports 102 of the connector body 101, the housing 112 is seated on the recess 106 and firmly engaged and supported by the supports 104 and the hook 105 and the protrusions 108 which firmly engage the slots 114 of the housing 112.

FIG. 13 is also a cross-sectional view of the connector 109 of the fourth embodiment of the invention taken along the line II—II of FIG. 7, illustrating the ribbon cable 10 coupled to the connector 109. As shown in FIG. 13, the connector body 101 includes a connector lead 103 mounted in each wire receiving port 102. The connector lead 103 is upwardly inserted into the connector body 101. The connector lead 103 has an elastic member 103A at one end thereof and an engaging member 103B at the intermediate portion thereof. The elastic member 103A serves to make the corresponding wire 13 come into close contact with the connector lead 103. When the connector lead 103 is inserted into the connector body 101, the engaging member 103B of connector lead 103 is engaged with a step 107 formed at an inner surface of the connector body 101 so as to prevent the connector lead 103 from being separated from the connector body 101.

As made apparent by the above description, the connectors of the present invention provide a connector for electric wires wherein supports, one of which has a hook, firmly engage and support a housing of a ribbon cable. As a result, the electrical connectors of the present help to prevent wires of a cable from being easily separated from the wire receiving ports of the connector due to external forces or tension applied to the cable.

In accordance with the present invention, the supports and the hooks of the connector can be formed by a single process step in formation of the connector body. Accordingly, a reduction in manufacturing cost and an increase in convenience in use is obtained.

In the embodiments of the connectors of the present invention, when a user optionally moves supports having a hook away from an opposing or facing support, the housing and thus the cable can be easily separated from the connector.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A connector for a cable having a plurality of electrical wires comprising:

a connector body;

a housing formed to support the plurality of wires of said cable integrally with one another and capable of being coupled to said connector body;

a plurality of wire receiving ports formed in said connector body, each port adapted to receive one wire of the cable; and at least two supports facing each other provided at opposite edges of the connector body, at least one support having a hook adapted to engage an edge of the housing, the supports adapted to support the housing so as to prevent the cable from being easily separated from the connector body when an external force or tension is applied to the cable.

2. A connector according to claim 1, wherein the supports are centrally located at their corresponding edges of the connector body to have a sufficient width to firmly support the housing of the cable.

3. A connector according to claim 1, wherein supports are provided at front and rear edges of an upper surface of the connector body, and the hook is provided only at one of the supports.

4. A connector according to claim 1, wherein supports are provided at left and right edges of an upper surface of the connector body.

5. A connector according to claim 3, wherein supports are provided at left and right edges of an upper surface of the connector body.

6. A connector according to claim 1, wherein the housing has a pair of protrusions formed at opposite side surfaces of the housing and supports have hooks adapted to engage the protrusions.

7. A connector according to claim 1, wherein an upper surface of the connector body has at least one protrusion for engaging a slot of the housing.

8. A connector according to claim 1, wherein the connector is a right angle connector.

9. A connector according to claim 1, wherein supports are provided at four corners of an upper surface of the connector body.

10. A connector according to claim 1, wherein a connector lead is mounted in each wire receiving port for engaging a wire of the cable.

11. A connector according to claim 10, wherein the connector lead includes an elastic member at one end where the elastic member makes the corresponding wire of the cable come into close contact with the connector lead.

12. A connector according to claim 11, wherein the connector lead includes an engaging member at an intermediate portion of the connector lead.

13. A connector according to claim 12, wherein the engaging member engages a step formed at an inner surface of the connector body.

14. A connector according to claim 1, wherein the a recess is centrally provided in an upper surface of the connector body for engaging the housing.

* * * * *